US005967387A

United States Patent [19]

Bakhtiar

[11] Patent Number: 5,967,387

[45] Date of Patent: Oct. 19, 1999

[54] ANTI-COLLAPSING SLEEVE SYSTEM

[76] Inventor: Mansoureh Bakhtiar, 34 Southbury Boundary Rd., London, England NW8 0R6, United Kingdom

[21] Appl. No.: 09/048,427

[22] Filed: Mar. 26, 1998

[51] Int. Cl.[6] ..... D06C 15/00

[52] U.S. Cl. ..... 223/84; 223/68

[58] Field of Search ..... 223/85, 92, 66, 223/67, 83, 84, 68

[56] References Cited

U.S. PATENT DOCUMENTS

| | | | |
|---|---|---|---|
| 1,526,389 | 2/1925 | Steen | 223/67 |
| 2,622,774 | 12/1952 | Freeman | 223/67 |
| 2,921,727 | 1/1960 | Lopez | 223/67 |
| 3,269,618 | 8/1966 | Humalainen | 223/84 |
| 4,533,072 | 8/1985 | Craig | 223/67 |
| 4,615,447 | 10/1986 | Walter | 223/85 |
| 5,575,410 | 11/1996 | Compton | 223/84 |

FOREIGN PATENT DOCUMENTS

| | | | |
|---|---|---|---|
| 25737 | 11/1904 | United Kingdom | 223/83 |
| 405771 | 2/1934 | United Kingdom | 223/84 |

*Primary Examiner*—Bibhu Mohanty

[57] ABSTRACT

A sleeve insert is provided including a tubular body that is selectively inflatable. Further provided is a sleeve insert including a flexible planar plate which is configurable as a tube with varying diameters.

2 Claims, 2 Drawing Sheets

FIG. 4
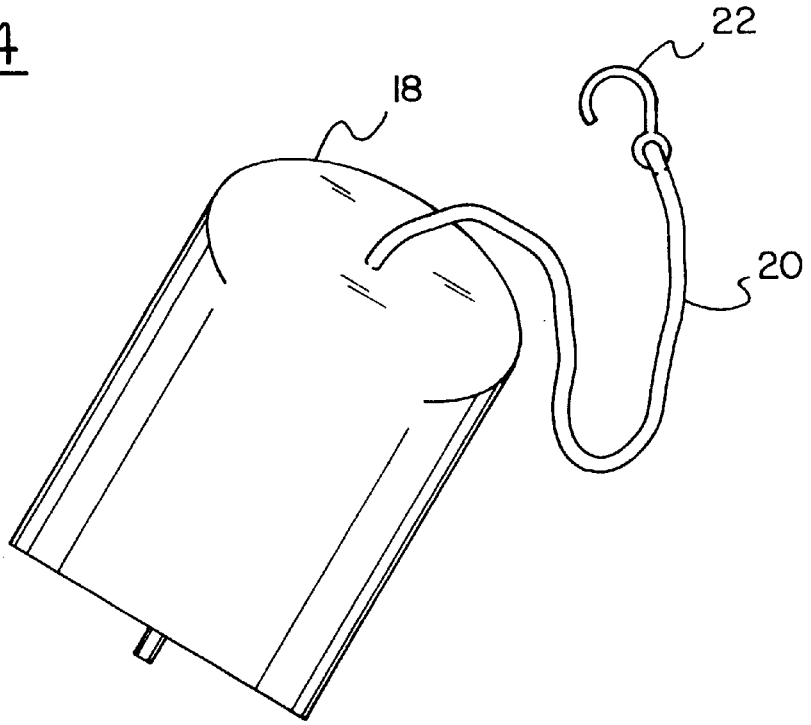
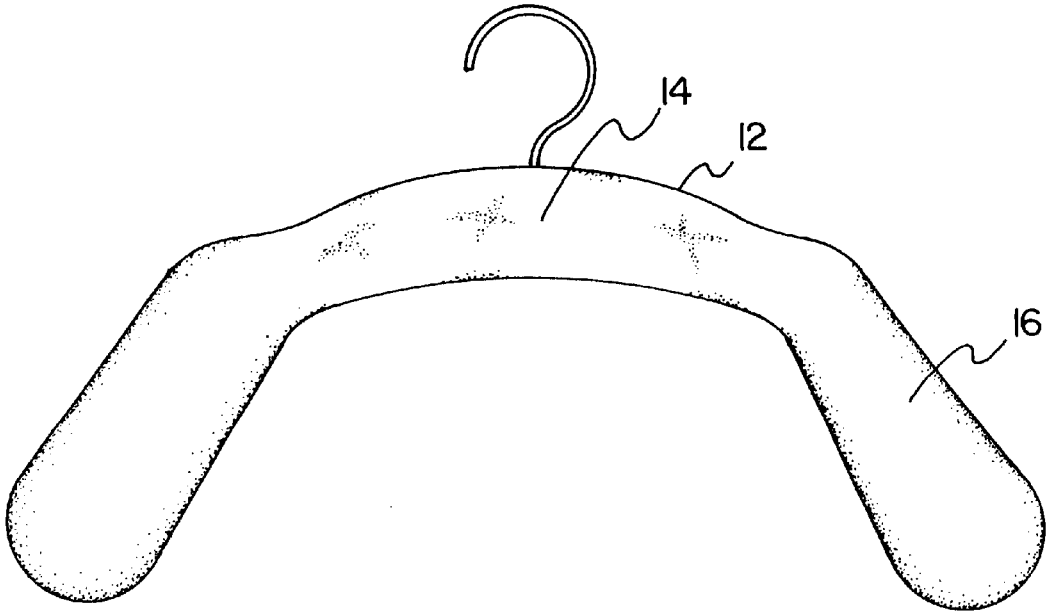
FIG. 5

ANTI-COLLAPSING SLEEVE SYSTEM

BACKGROUND OF THE INVENTION

1. Field of the Invention

The present invention relates to hangers and more particularly pertains to a new anti-collapsing sleeve system for preventing the collapsing and wrinkling of a sleeve of an article of clothing.

2. Description of the Prior Art

The use of hangers is known in the prior art. More specifically, hangers heretofore devised and utilized are known to consist basically of familiar, expected and obvious structural configurations, notwithstanding the myriad of designs encompassed by the crowded prior art which have been developed for the fulfillment of countless objectives and requirements.

Known prior art hangers include U.S. Pat. No. 4,738,381; U.S. Pat. No. 4,184,616; U.S. Pat. No. 4,026,447; U.S. Pat. No. 5,388,734; and U.S. Pat. No. Des. 354,402.

In these respects, the anti-collapsing sleeve system according to the present invention substantially departs from the conventional concepts and designs of the prior art, and in so doing provides an apparatus primarily developed for the purpose of preventing the collapsing and wrinkling of a sleeve of an article of clothing.

SUMMARY OF THE INVENTION

In view of the foregoing disadvantages inherent in the known types of hangers now present in the prior art, the present invention provides a new anti-collapsing sleeve system construction wherein the same can be utilized for preventing the collapsing and wrinkling of a sleeve of an article of clothing.

The general purpose of the present invention, which will be described subsequently in greater detail, is to provide a new anti-collapsing sleeve system apparatus and method which has many of the advantages of the hangers mentioned heretofore and many novel features that result in a new anti-collapsing sleeve system which is not anticipated, rendered obvious, suggested, or even implied by any of the prior art hangers, either alone or in any combination thereof.

To attain this, the present invention generally comprises a hanger including an intermediate extent with slightly arcuate top and bottom edges. The intermediate extent has a hook coupled to a top central extent thereof which extends upwardly therefrom. The hook thus functions for removably hanging on a horizontally oriented rod to store a jacket thereon. The hanger further includes a pair of end extents each with an inboard end coupled to outboard ends of the intermediate extent and extended outwardly and downwardly therefrom. Each end extent has linear top and bottom edges and an outboard end defining a portion of a sphere. FIG. 4 shows one of a pair of first sleeve inserts including an inflatable body having a cylindrical configuration. Each of the first sleeve inserts thus are defined by a circular top face, a circular bottom face and a smooth tubular periphery formed therebetween. The top face has a flexible string with a first end coupled to a central extent thereof. A second end of the string is equipped with a hook formed thereon for releasably coupling with an aperture formed in the outboard end of an associated one of the end extents of the hanger. It should be understood that the sleeve inserts can be used with the hanger or independently. As such, the first sleeve inserts each remain within a selected portion of the corresponding sleeve and prevents the same from collapsing. FIG. 3 shows a pair of second sleeve inserts each formed of a resilient flexible planar sheet. Each sheet has a periphery defined by a first linear end edge of a first length and a second linear end edge of a second length greater than the first length. Further, a pair of tapering linear side edges are formed between the first and second linear edges. Each of the second sleeve inserts further includes a plurality of parallel columns of linearly aligned spaced apertures formed adjacent to the first linear end edge and parallel therewith. A single row of linearly aligned spaced posts are formed adjacent to the second linear end edge of each plate for releasably coupling with a selected one of the columns of apertures. By such interconnection, each second sleeve insert defines a cylinder of a predetermined diameter.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new anti-collapsing sleeve system apparatus and method which has many of the advantages of the hangers mentioned heretofore and many novel features that result in a new anti-collapsing sleeve system which is not anticipated, rendered obvious, suggested, or even implied by any of the prior art hangers, either alone or in any combination thereof.

It is another object of the present invention to provide a new anti-collapsing sleeve system which may be easily and efficiently manufactured and marketed.

It is a further object of the present invention to provide a new anti-collapsing sleeve system which is of a durable and reliable construction.

An even further object of the present invention is to provide a new anti-collapsing sleeve system which is susceptible of a low cost of manufacture with regard to both materials and labor, and which accordingly is then susceptible of low prices of sale to the consuming public, thereby making such anti-collapsing sleeve system economically available to the buying public.

Still yet another object of the present invention is to provide a new anti-collapsing sleeve system which provides in the apparatuses and methods of the prior art some of the advantages thereof, while simultaneously overcoming some of the disadvantages normally associated therewith.

Still another object of the present invention is to provide a new anti-collapsing sleeve system for preventing the collapsing and wrinkling of a sleeve of an article of clothing.

Even still another object of the present invention is to provide a new anti-collapsing sleeve system that includes a tubular body that is selectively inflatable. Further provided is a sleeve insert including a flexible planar plate which is configurable as a tube with varying diameters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective view of the first sleeve insert of the present invention.

FIG. 5 is a perspective view of the hanger of the present invention.

DESCRIPTION OF THE PREFERRED EMBODIMENT

Figure 1:
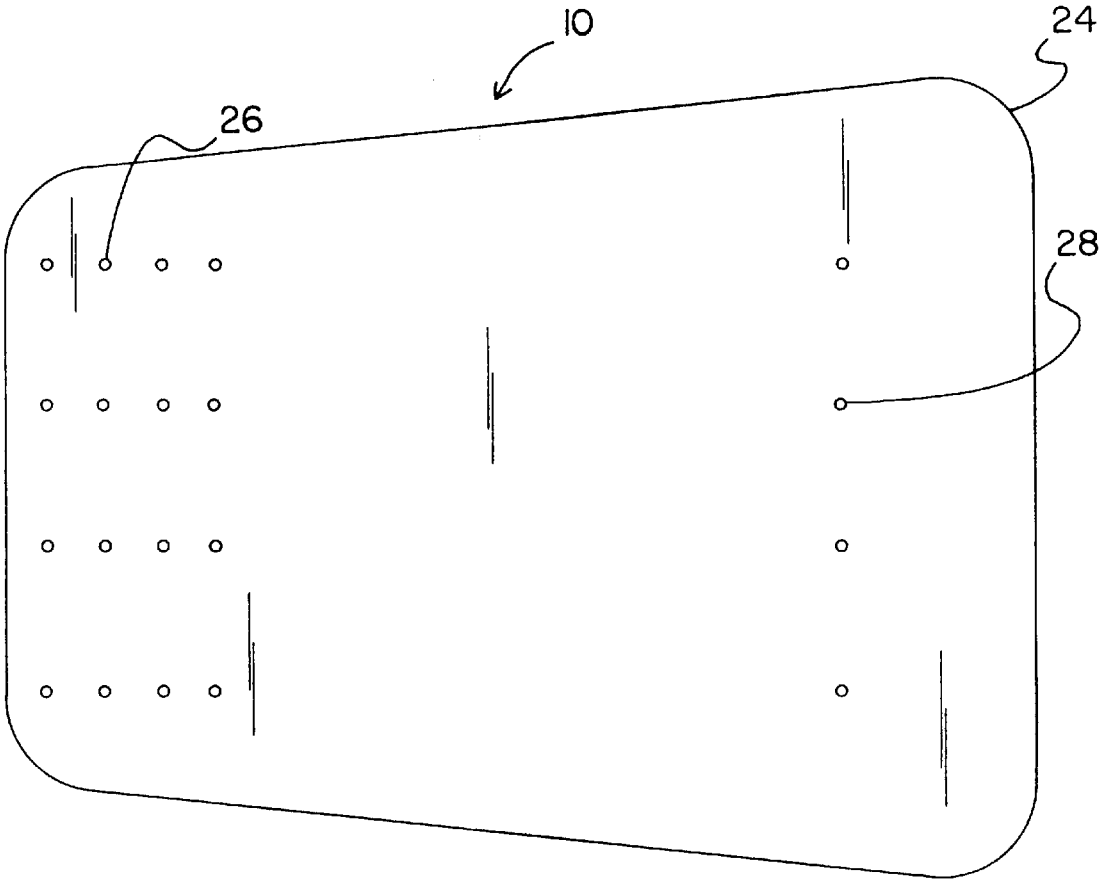
FIG. 1 is a top view of a new anti-collapsing sleeve system according to the present invention.
Figure 2:
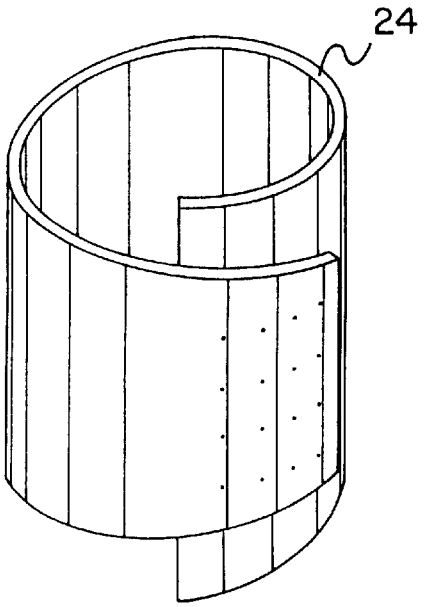
FIG. 2 is a perspective view of one of the second sleeve inserts of the present invention ready for use.

With reference now to the drawings, and in particular to FIGS. 1 through 5 thereof, a new anti-collapsing sleeve system embodying the principles and concepts of the present invention and generally designated by the reference numeral 10 will be described.

The present invention, designated as numeral 10, includes a hanger 12 having an intermediate extent 14 with slightly arcuate top and bottom edges. The intermediate extent has a hook coupled to a top central extent thereof which extends upwardly therefrom. The hook thus functions for removably hanging on a horizontally oriented rod to store a jacket thereon.

The hanger further includes a pair of end extents 16 each with an inboard end coupled to outboard ends of the intermediate extent and extended outwardly and downwardly therefrom. Each end extent is linear and has an outboard end defining a portion of a sphere. In the preferred embodiment, the hanger is lined with a soft material such as felt or the like.

FIG. 4 shows one of a pair of first sleeve inserts 18 including an inflatable body having a cylindrical configuration. Each of the first sleeve inserts thus are defined by a circular top face, a circular bottom face and a smooth tubular periphery formed therebetween. The top face has a flexible string 20 with a first end coupled to a central extent thereof. A second end of the string is equipped with a hook 22 formed thereon for releasably coupling with an unillustrated aperture formed in the outboard end of an associated one of the end extents of the hanger. As such, the first sleeve inserts each remains within a selected portion of the corresponding sleeve and prevents the same from collapsing. As shown in FIG. 4, the bottom face of each of the first sleeve inserts is equipped with a valve for the selective inflation and deflation of the inflatable body.

Figure 3:
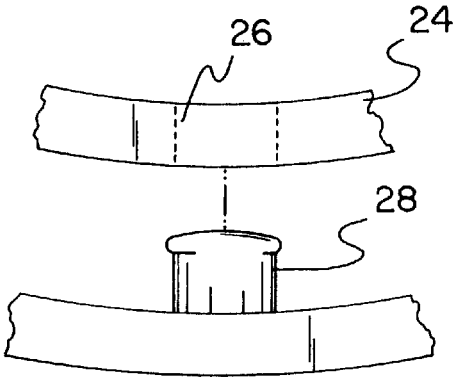
FIG. 3 is an exploded view of the interconnection between the first and second linear edges of a second sleeve of the present invention.

FIG. 3 shows a pair of second sleeve inserts 24 each formed of a resilient flexible planar sheet. Each sheet has a periphery defined by a first linear end edge of a first length and a second linear end edge of a second length greater than the first length. Further, a pair of tapering linear side edges are formed between the first and second linear edges.

Each of the second sleeve inserts further includes four parallel columns of linearly aligned spaced apertures 26 formed adjacent to the first linear end edge and parallel therewith. A single row of linearly aligned spaced posts 28 are formed adjacent to the second linear end edge of each plate for releasably coupling with a selected one of the columns of apertures. By such interconnection, each second sleeve insert defines a cylinder of a predetermined diameter. It should be noted that each post has an elongated cylindrical inboard portion and a cone-shaped outboard portion for facilitating the aforementioned interconnection.

During use, the second sleeve insert may be selectively situated within the sleeve of the jacket for preventing the same from collapsing. It should be noted that the first and second sleeve inserts may either be used in combination or separate depending on the desires of the user. Both sleeve inserts are preferably about 14 to about 30 inches in length.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sleeve insert system, wherein the system includes a pair of sleeve inserts each formed of a resilient flexible planar sheet with a periphery defined by a first end edge of a first length, a second end edge of a second length greater than the first length, and a pair of tapering linear side edges formed therebetween, each of the sleeve inserts further including a plurality of columns of aligned spaced apertures formed adjacent to the first end edge and parallel therewith, each of the sleeve inserts further having a single row of linearly aligned spaced posts formed adjacent to the second end edge for releasably coupling with a selected one of the columns of apertures such that each second sleeve insert defines a cylinder of a predetermined diameter, whereby each sleeve insert may be selectively situated within the sleeve of the jacket for preventing the same from collapsing.

2. A sleeve insert system wherein the system includes a pair of sleeve inserts each formed of a resilient flexible planar sheet with a periphery defined by a first linear end edge of a first length, a second linear end edge of a second length greater than the first length and a pair of tapering linear side edges formed therebetween, each of the sleeve inserts further including a plurality of parallel columns of linearly aligned spaced apertures formed adjacent to the first linear end edge and parallel therewith, each of the sleeve inserts further having a single row of linearly aligned spaced posts formed adjacent to the second linear end edge for releasably coupling with a selected one of the columns of apertures such that each second sleeve insert defines a cylinder of a predetermined diameter, whereby each sleeve insert may be selectively situated within the sleeve of the jacket for preventing the same from collapsing.

* * * * *